US010421200B1

(12) United States Patent
Schuster

(10) Patent No.: US 10,421,200 B1
(45) Date of Patent: Sep. 24, 2019

(54) CONVERTIBLE KNIFE

(71) Applicant: Alan Schuster, Rockaway Park, NY (US)

(72) Inventor: Alan Schuster, Rockaway Park, NY (US)

( * ) Notice: Subject to any disclaimer, the term of this patent is extended or adjusted under 35 U.S.C. 154(b) by 0 days.

(21) Appl. No.: 15/623,778

(22) Filed: Jun. 15, 2017

Related U.S. Application Data

(60) Provisional application No. 62/350,817, filed on Jun. 16, 2016.

(51) Int. Cl.

| | |
|---|---|
| ***B26B 1/02*** | (2006.01) |
| ***B26B 3/04*** | (2006.01) |
| ***B26B 1/10*** | (2006.01) |
| ***B26B 9/00*** | (2006.01) |

(52) U.S. Cl.
CPC ..... *B26B 1/10* (2013.01); *B26B 1/02* (2013.01); *B26B 3/04* (2013.01); *B26B 9/00* (2013.01)

(58) Field of Classification Search
CPC ..... B26B 3/04; B26B 1/02
USPC ..... 30/399, 304, 114–117, 152
See application file for complete search history.

(56) References Cited

U.S. PATENT DOCUMENTS

| | | | | |
|---|---|---|---|---|
| 1,814,528 | A | 7/1931 | Purcell | |
| 1,877,211 | A | 9/1932 | Webster | |
| 2,134,839 | A | 11/1938 | Perkins | |
| 2,250,237 | A * | 7/1941 | Schwartzkopf | B26B 3/04 279/53 |
| 4,472,879 | A | 9/1984 | Sizemore, Jr. | |
| 4,578,865 | A * | 4/1986 | Keller | B26B 5/008 30/162 |
| 5,100,391 | A * | 3/1992 | Schutte | A61B 17/3213 30/304 |
| 5,680,705 | A | 10/1997 | Josoha | |
| 7,322,985 | B2 * | 1/2008 | Lee | A61B 17/144 606/71 |
| 7,909,683 | B1 * | 3/2011 | Waltman | B26B 3/04 452/149 |
| 8,438,737 | B2 * | 5/2013 | Lo | B26B 3/04 30/114 |
| 2004/0231163 | A1 * | 11/2004 | Sakai | B26B 11/00 30/146 |
| 2006/0272162 | A1 * | 12/2006 | Atwater | A21C 11/106 30/303 |
| 2016/0052154 | A1 * | 2/2016 | Goins | B26B 25/005 30/307 |

FOREIGN PATENT DOCUMENTS

| | | |
|---|---|---|
| CN | 2837011 Y | 11/2006 |
| CN | 203031620 U | 7/2013 |

* cited by examiner

*Primary Examiner* — Kenneth E Peterson
*Assistant Examiner* — Fernando A Ayala
(74) *Attorney, Agent, or Firm* — Myers Wolin, LLC

(57) ABSTRACT

A knife is provided having both a multi-blade configuration for cutting multiple slices simultaneously as well as a single blade configuration for storage and single cuts. In some embodiments, the multiple blade configuration may be adjustable to define varying distances between the multiple blades.

9 Claims, 8 Drawing Sheets

CONVERTIBLE KNIFE

CROSS REFERENCE TO RELATED APPLICATION

This present application takes priority from Provisional Patent Application 62/350,817, filed Jun. 16, 2016, the entire contents of which are incorporated herein by reference.

FIELD OF THE INVENTION

The invention relates to a knife that can convert from a first configuration to a second configuration.

BACKGROUND

Knives are often used to cut multiple slices of substances, such as food. Typically, a knife must be used to cut each individual slice by using repeated slicing motions. This activity is time consuming, tedious, and potentially dangerous for people without much experience.

While some multi-blade choppers exist, allowing for multiple simultaneous slices of food, they are typically clunky and difficult to handle. Further, they are difficult to store, since they do not fit in traditional knife blocks, and impossible to use when only a single, more precise, cut is needed. Further, such choppers lack adjustments, so that if a user wishes to vary the spacing between slices of food, they must use a single knife instead of such a chopper.

There is a need for a single knife that can be used in either a multi-blade configuration for cutting multiple slices simultaneously or a single blade configuration for storage and for more precise cuts.

SUMMARY

A knife is provided having both a multi-blade configuration for cutting multiple slices simultaneously as well as a single blade configuration for storage and single cuts. In some embodiments, the multiple blade configuration may be adjustable to define varying distances between the multiple blades.

Such a knife may comprise a handle and a plurality of individual blades movably fixed to the handle, where the plurality of individual blades has a first configuration, where the blades are in distinct planes. The plurality of individual blades may have a second configuration, wherein the plurality of individual blades are substantially coplanar and form a combined blade.

The distinct planes of the individual blades in the first configuration may be parallel and may be spaced apart, and the individual blades, or segments thereof, may be coextensive when the blades form a combined blade on the second configuration. In such a configuration, a total width of the combined blade would typically be less than the combined widths of the individual blades.

The individual blades typically each have a knife edge at a first edge of the blade, and at least one of the individual blades would have a seat for retaining the knife edge at a second edge of the blade. Accordingly, when the blades are coplanar, the knife edge from one of the plurality of blades may sit in a seat of a second of the plurality of blades.

When the individual blades are in the first configuration, they may be translatable relative to each other, such that the amount by which the distinct planes are spaced apart is adjustable.

Typically, the blades may be transitioned from the first configuration to the second configuration by rotating each blade about a respective rotational axis running the length of the corresponding blade. The handle may have a length extending in parallel with the rotational axes of the individual blades.

In an alternative chopper embodiment, the handle may extend in a direction perpendicular to the rotational axes of the blades.

In some embodiments, the rotational axes of the individual blades translate relative to each other during the transition from the first configuration to the second configuration.

DETAILED DESCRIPTION OF THE PREFERRED EMBODIMENTS

Figure 1:
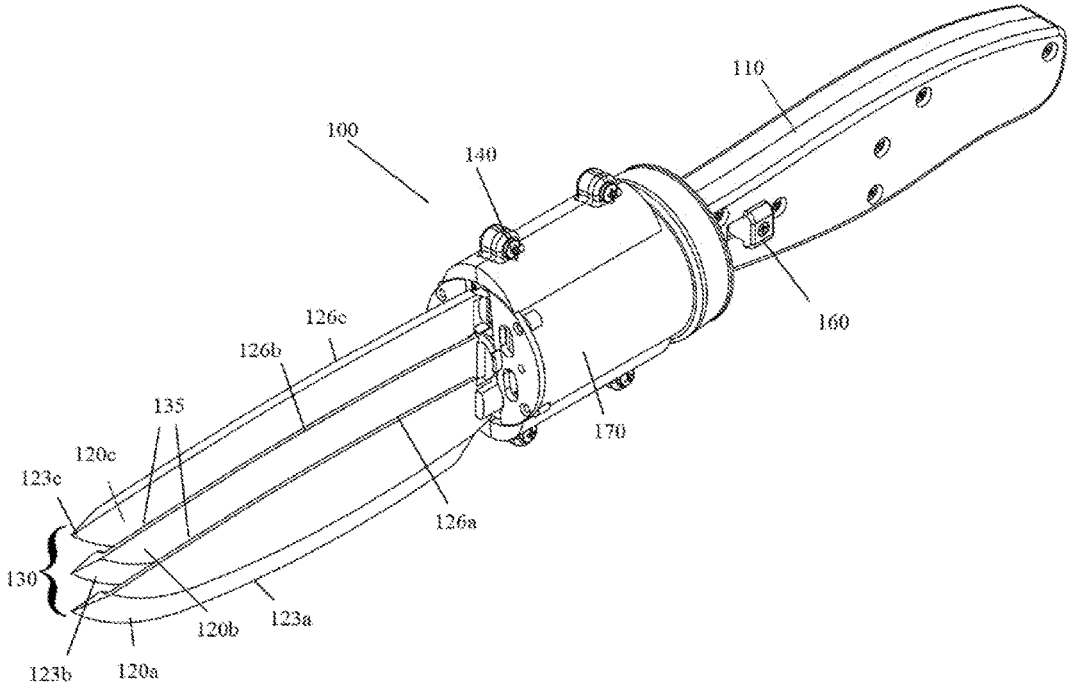
FIG. 1 shows a first view of a knife in a first configuration.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
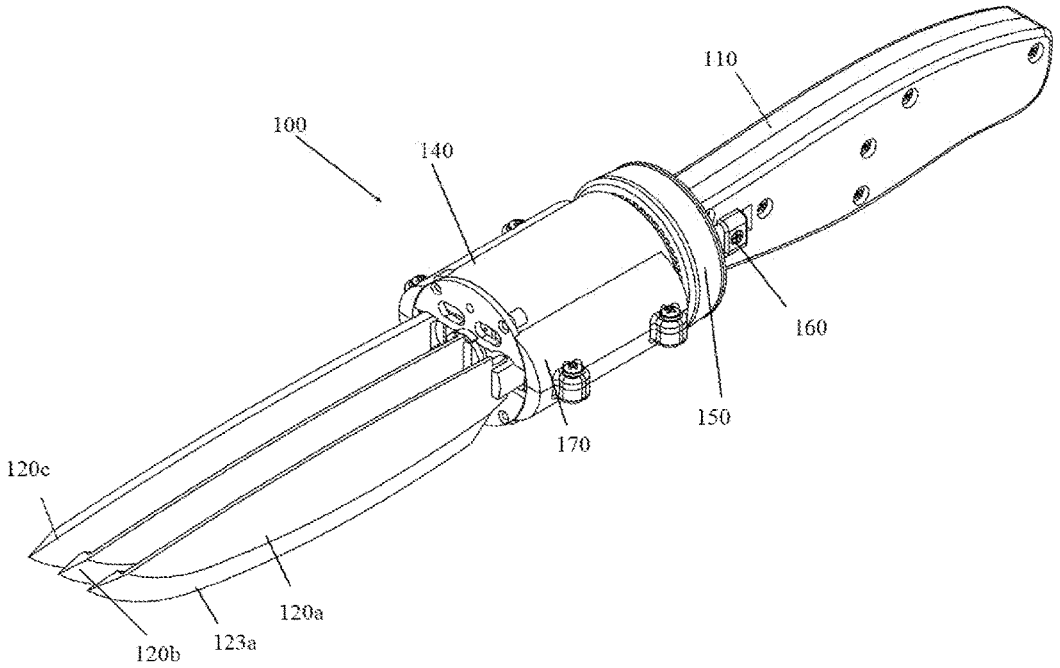
FIG. 2 shows a first view of the knife of FIG. 1 in a second configuration.
Figure 3:
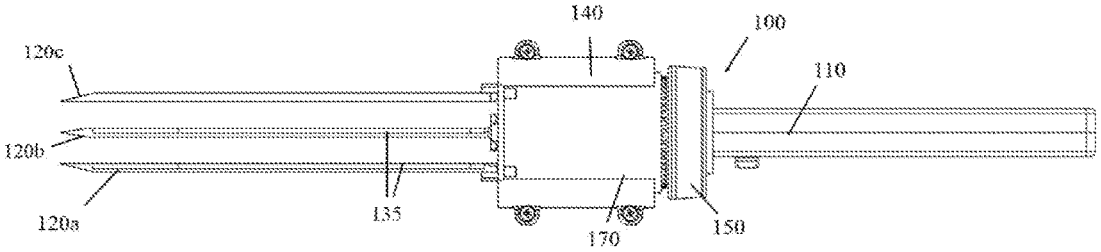
FIG. 3 shows a second view of the knife of FIG. 1 in the second configuration.

FIG. 1 shows a knife 100 in a first configuration and FIGS. 2 and 3 show the knife in a second configuration. The knife 100 comprises a handle 110 and a plurality of individual blades 120*a-c* movably fixed to the handle 110. The individual blades 120*a-c* are fixed to the handle 110 by way of a converter 140 that converts the knife from the first configuration to the second configuration and vice versa.

When in the first configuration, the knife 100 has a plurality of individual blades 120*a-c* that are substantially coplanar and form a combined blade 130. In the first configuration, portions of the blades 120*a-c* may overlap, which may in turn stabilize the combined blade. In the first configuration, the knife 100 may be used as a traditional knife with a single blade.

In the configuration shown, each knife blade 120*a-c* has a sharpened edge, 123*a-c* and a non-sharpened edge 126*a-c*. In some configurations, the non-sharpened edge 126*a-c* of each blade 120*a-b* may be provided with a seat 135 for a second blade 120*b-c* in order to stabilize the blades when they overlap. Accordingly, in the first configuration, the sharpened edge 123*a* of the first knife blade 120*a* functions as the knife blade for the combined blade 130.

The knife 100 also has the second configuration shown in FIGS. 2 and 3, wherein the plurality of individual blades 120*a-c* are positioned in distinct planes, typically parallel to each other. In the second configuration, the sharpened edge 123*a-c* of each blade 120*a-c* of the knife 100 may be used to cut multiple slices of a substance simultaneously. Where the individual blades 120*a-c* are parallel, the slices cut by the blade will be parallel as well.

In the embodiment shown, the knife 100 may be converted from the first configuration, shown in FIG. 1, to the second configuration, shown in FIGS. 2 and 3, by rotating the converter 140 relative to the handle 110. The knife 100 may further be provided with a lock 160 which must be released in order to allow the rotation of the converter 140.

Upon rotating the converter 140 or otherwise converting the knife 100 from the first configuration to the second configuration, each individual knife blade 120*a-c* are rotated about a respective rotational axis, the rotational axis running along a length of the corresponding individual blade. In the embodiment shown, the length of the knife handle 110 extends in parallel to the rotational axes of each of the individual blades 120*a-c*.

Figure 4A:
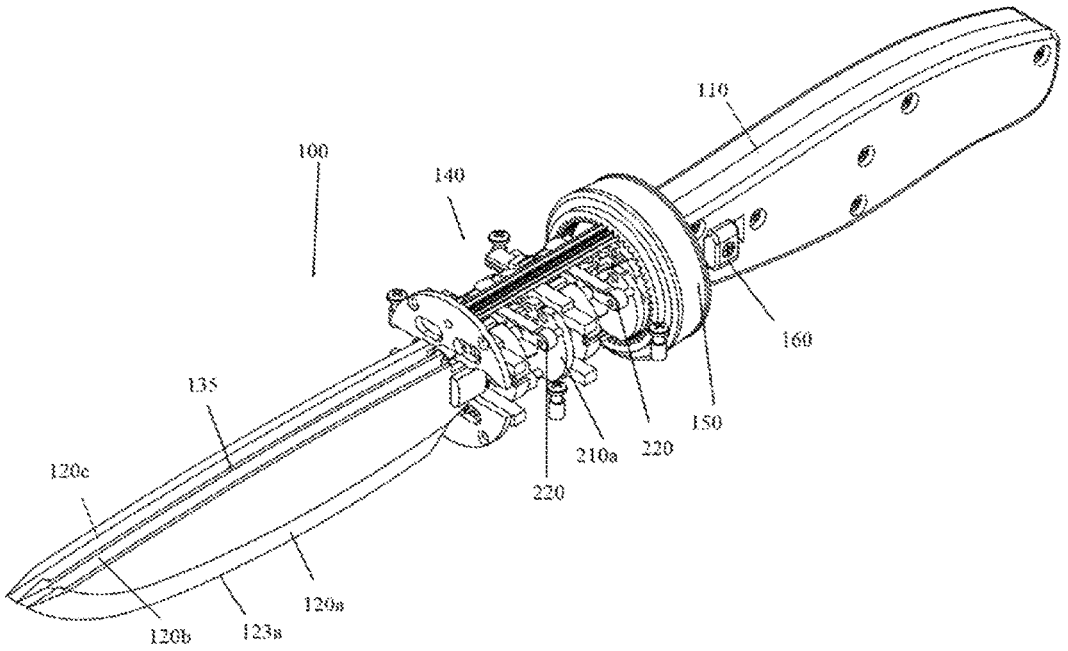
FIGS. 4A-4B show the knife of FIG. 1 in a third configuration.
Figure 4B:
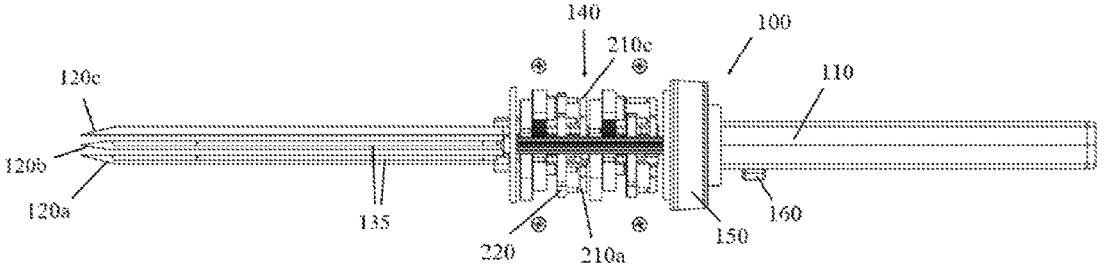

In addition to a converter 140 for converting the knife 100 from the first configuration to the second configuration, the knife 100 may be provided with an adjuster 150 for adjusting the space or angle between the blades 120*a-c*. FIGS. 4A and 4B show the knife 100 of FIG. 1 in a third configuration in which the individual blades 120*a-c* remain in distinct planes, typically parallel to each other, but they are spaced differently than in the second configuration. As shown, the blades 120*a-c* may be closer together, for example. Although the third configuration is shown with a housing 170 for the converter 140 removed, it will be understood that the housing may remain in place in each configuration.

The knife 100 may then be used to make parallel cuts simultaneously, where the cuts are farther apart than in the second configuration. In the embodiment shown, the knife 100 is provided with an adjuster 150 and may be transitioned from the second configuration to the third configuration by rotating the adjuster 150 relative to the converter 140. In some embodiments, the adjuster 150 will be required to be unlocked from the mechanism used to transition the knife 100 from the first configuration, shown in FIG. 1 to the second configuration, shown in FIG. 2, in order to allow for it to be used to transition between the second configuration and the third configuration, shown in FIGS. 4A and 4B. For example, it may be unlocked by pulling the adjuster 150 away from the converter 140.

Figure 5:
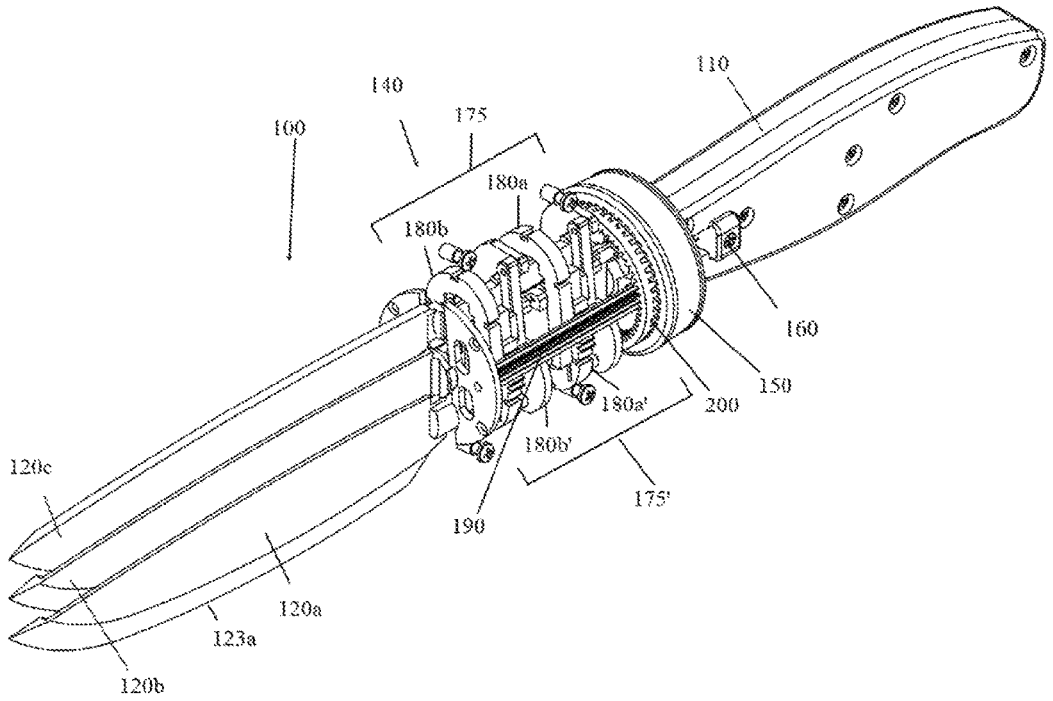
FIG. 5 shows the knife of FIG. 1 with its housing removed.
Figure 6:
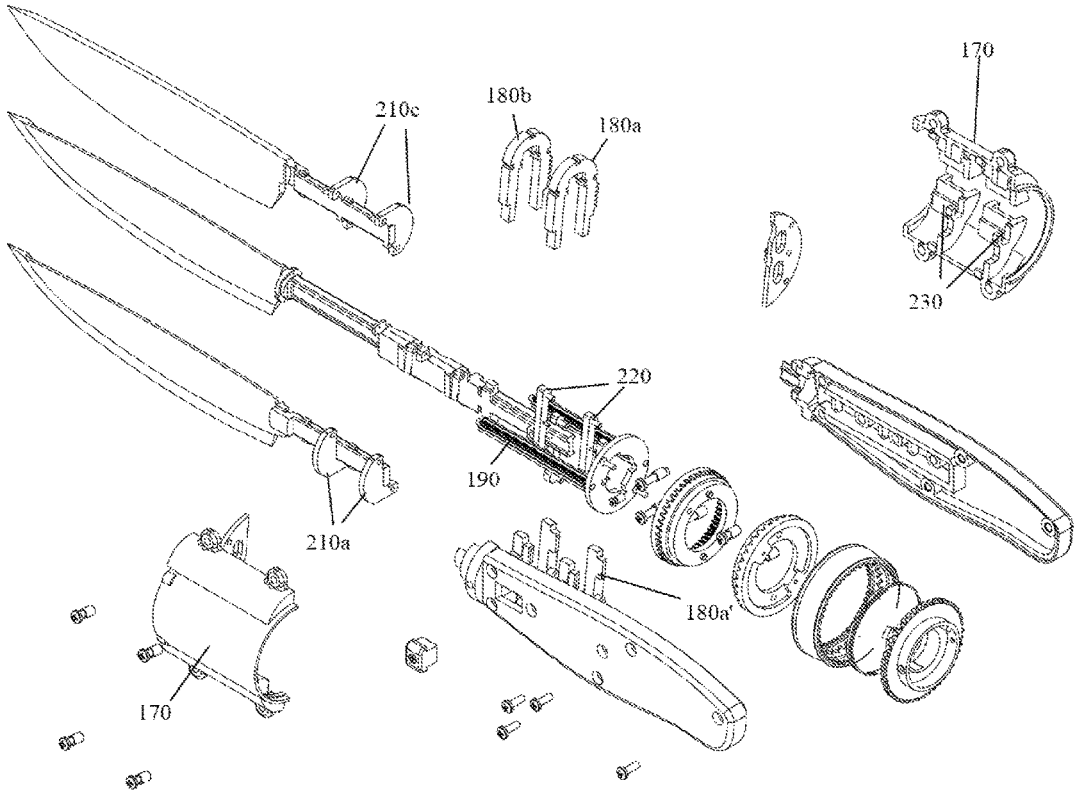
FIG. 6 shows an exploded view of the knife of FIG. 1.

FIG. 5 shows the knife 100 of FIG. 1 with a housing 170 for the converter 140 removed and FIG. 6 shows an exploded version of the knife 100 of FIG. 1. As shown, the converter 140 has a housing 170 that houses a rack and pinion mechanism 175 visible from the top of the knife 100 comprising two racks 180*a-b* and a single pinion 190 crossing both of those racks. A parallel mechanism 175' may be provided on the bottom of the knife with parallel components providing additional stability and applying required motion in an opposite direction. The rack and pinion mechanisms 175, 175' control the transition from the second configuration to the third configuration. By rotating the pinions 190, 190', the pinion engages the racks 180*a-b*, 180*a-b'* and translates the plurality knife blades 120*a-c* relative to each other. By rotating in a first direction, the blades may be drawn closer together by drawing the racks towards the central blade, and by rotating in a second direction, the blades may be moved farther apart. As can be seen in FIG. 6, the first rack and pinion mechanism 175 applies the adjustments to the first blade 120*a* and the second mechanism 175' applies opposite adjustments to the third blade 120*c*, with the second blade 120*b* remaining stable at a center point between those blades.

Also within the housing 170 is a rotational mechanism 200 that controls the transition of the knife 100 from the first configuration, shown in FIG. 1 to the second configuration shown in FIG. 2. Fixed to each of the first blade 120*a* and the third blade 120*c* is a pair of rotation plates 210*a*, 210*c*. These rotation plates are connected to each other by cross bars 220 and are retained by braces 230 on an interior of the housing 170. Accordingly, when the lock 160 releases the mechanism and the housing 170 is rotated, the rotation plates are revolved about a central axis along the second knife blade 120*b* while the attached knife blades 120*a*, 120*c* are held in an orientation parallel to each other and the central knife blade 120*b*. Accordingly, by rotating the housing 170 in a first direction, the knife 100 may be transitioned from the first configuration to the second configuration and by rotating the housing in a second direction, the knife may be transitioned from the second configuration to the first configuration.

Figure 7A:
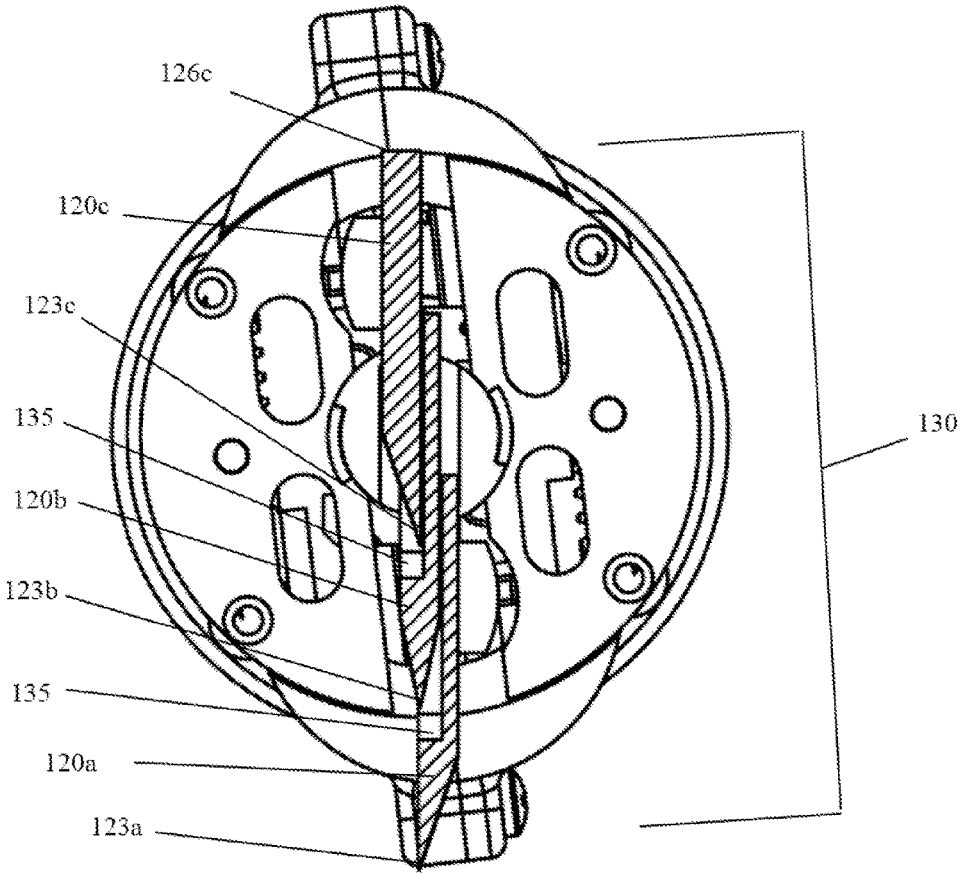
FIGS. 7A-B show detailed views of an embodiment of a knife in the first configuration.
Figure 7B:
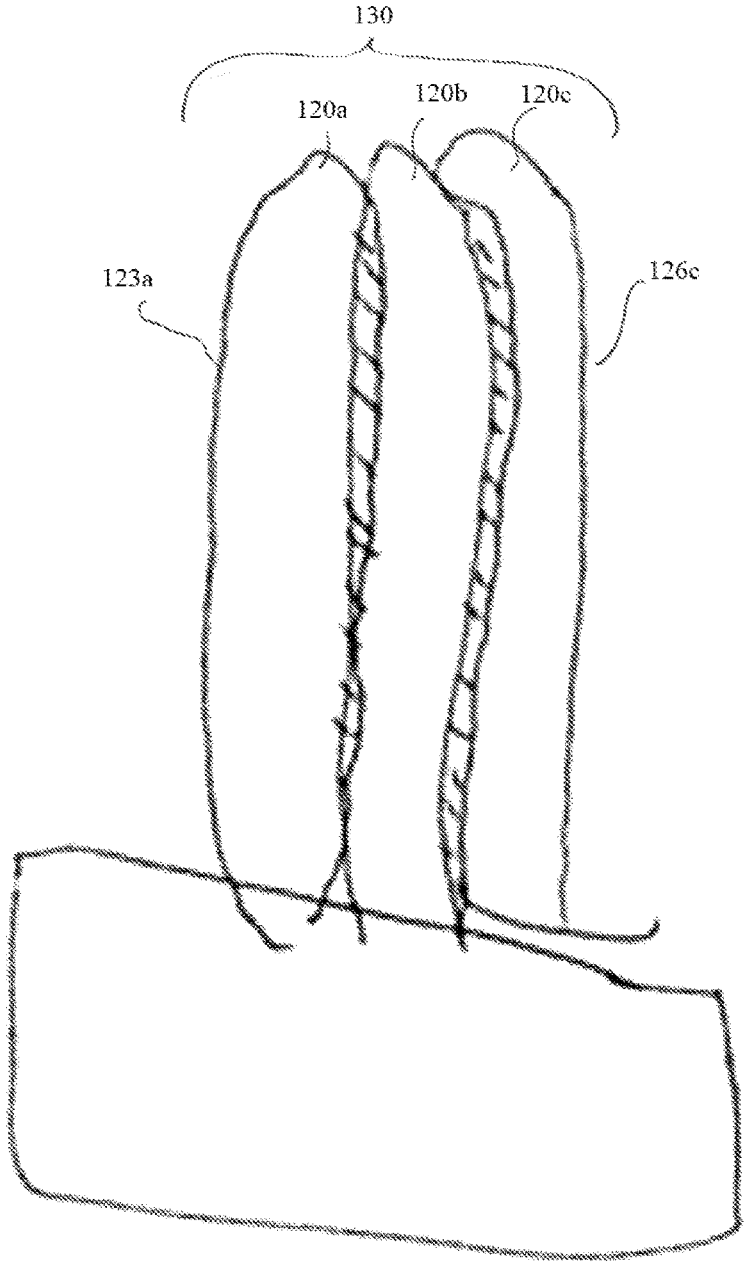

FIGS. 7A and 7B show a detail of the knife 100 of FIG. 1 in the first configuration. As shown, each blade 120*a-c* of the knife 100 may overlap the next blade, such that a single blade 130 is formed.

Figure 8:
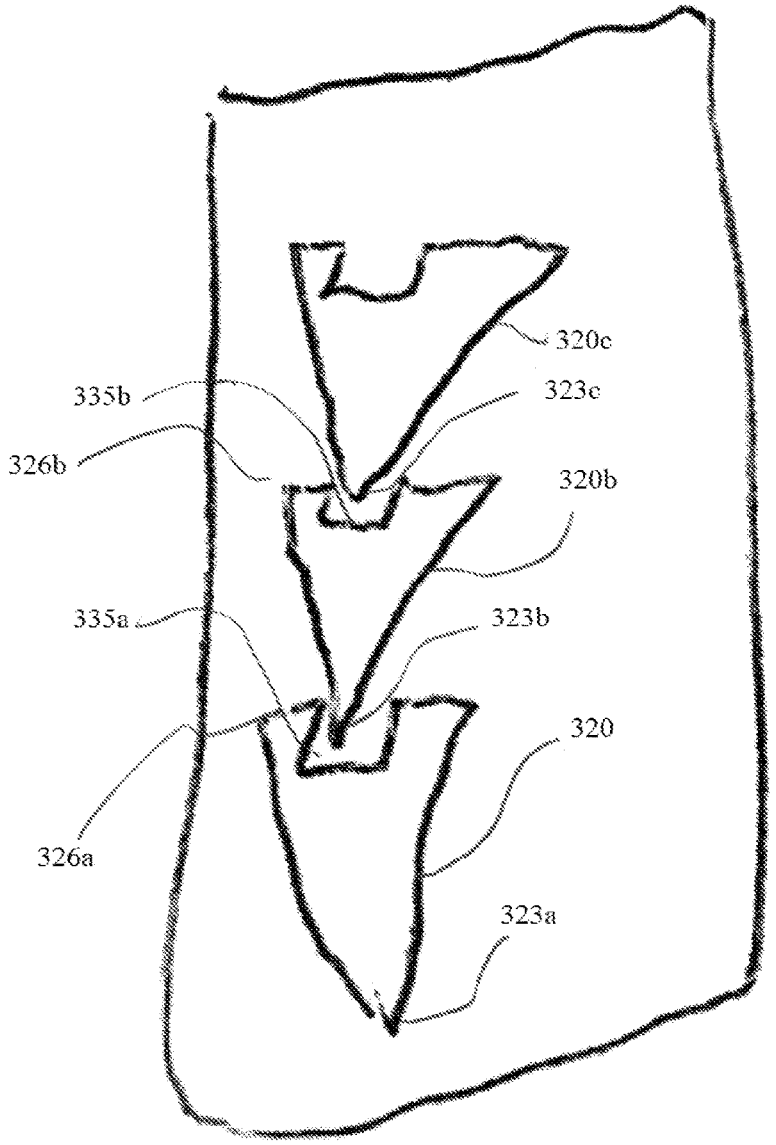
FIG. 8 show a detail of a second embodiment of a knife in the first configuration.

FIG. 8 shows a detail of a second embodiment of a knife in a first configuration having three knife blades 320*a-c*, with the blade edge 323*a-c* of each of a second and third knife blade 320*b-c* sitting in a seat 335*a-b* on the spine 326*a-b* of the first and second blade respectively.

While the figures show a knife embodiment, the mechanism described may also be incorporated into a chopper such that a chopper may be provided with parallel blades in one configuration and with coextensive blades, forming a single blade, in a second configuration. In such a chopper configuration, a length of a handle of the chopper may extend in a direction perpendicular to the rotational axes of the individual blades.

Further, while the figures shown provide a knife with three blades combining to form a single blade, additional configurations are contemplated in which additional blades are provided, such that the single blade 130 comprises four or more individual blades.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A knife comprising: a handle; and a plurality of individual blades movably fixed to the handle, wherein each of the individual blades has a sharpened edge and a non-sharpened edge; wherein the plurality of individual blades has a first configuration, wherein the plurality of individual blades are in distinct planes and a second configuration, wherein the plurality of individual blades are partially overlapping and form blade portions of a combined blade, wherein a non-sharpened edge of a first blade portion contacts a sharpened edge of a second blade portion of the combined blade, wherein the individual blades each have a length and width, the length being longer than the width for each blade, and wherein the sharpened edges of the blades are located along the length of the blades; wherein the individual blades transition from the first configuration to the second configuration by rotating each individual blade about a respective rotational axis, the rotational axis being parallel the length of the corresponding individual blade.

2. The knife of claim 1 wherein the distinct planes are parallel.

3. The knife of claim 1 wherein the total width of the combined blade is less than the sum of the widths of the individual blades.

4. The knife of claim 3 wherein segments of the individual blades are coextensive when they form the combined blade.

5. The knife of claim 1 wherein the sharpened edge of at least one of the individual blades is at a first edge of the individual blade and a seat for retaining a sharpened edge of another of the individual blades is at a second edge of the one individual blade opposite the sharpened edge thereof, and wherein a second of the individual blades has the sharpened edge thereof at one edge of the other individual blade, and wherein the sharpened edge of the other blade sits in the seat of the one blade when the blades form a combined blade.

6. The knife of claim 1 wherein the distinct parallel planes are spaced apart.

7. The knife of claim 1 wherein the individual blades are translatable relative to each other, such that the amount by which the distinct planes are spaced apart is adjustable.

8. The knife of claim 1 wherein the handle has a length extending in parallel to the rotational axes of the individual blades.

9. The knife of claim 1 wherein the rotational axes translate relative to each other during the transition from the first configuration to the second configuration.

* * * * *